US011406951B2

(12) United States Patent
Shi et al.

(10) Patent No.: US 11,406,951 B2
(45) Date of Patent: Aug. 9, 2022

(54) CONTINUOUS AND FORCED ASPHALT MIXING PRODUCTION METHOD

(71) Applicant: SHANGHAI SHISHEN INDUSTRY AND TRADE CO., LTD., Shanghai (CN)

(72) Inventors: Guangsheng Shi, Shanghai (CN); Zhaowu Shi, Shanghai (CN); Qingzhao Shi, Shanghai (CN)

(73) Assignee: SHANGHAI SHISHEN INDUSTRY AND TRADE CO., LTD., Shanghai (CN)

( * ) Notice: Subject to any disclaimer, the term of this patent is extended or adjusted under 35 U.S.C. 154(b) by 99 days.

(21) Appl. No.: 17/029,057

(22) Filed: Sep. 23, 2020

(65) Prior Publication Data

US 2021/0113977 A1 Apr. 22, 2021

(30) Foreign Application Priority Data

Oct. 16, 2019 (CN) ..... 201910984537.9
Oct. 16, 2019 (CN) ..... 201910984563.1
Jan. 15, 2020 (CN) ..... 202010043651.4

(51) Int. Cl.
*B01F 101/38* (2022.01)
*B01F 33/80* (2022.01)
(Continued)

(52) U.S. Cl.
CPC ..... *B01F 33/8052* (2022.01); *B01F 27/116* (2022.01); *B01F 35/90* (2022.01);
(Continued)

(58) Field of Classification Search
CPC ..... B01F 2035/99; B01F 2101/38; B01F 27/116; B01F 33/8052; B01F 33/8364;
(Continued)

(56) References Cited

U.S. PATENT DOCUMENTS 4,177,080 A * 12/1979 Mendenhall ..... E01C 19/1036 106/281.1
4,921,730 A * 5/1990 Sasaki ..... E01C 19/1004 427/403
(Continued)

FOREIGN PATENT DOCUMENTS

CN 1207465 6/2005
CN 102463022 5/2012
(Continued)

OTHER PUBLICATIONS

"Office Action of China Counterpart Application", dated Feb. 26, 2021, p. 1-p. 5.

*Primary Examiner* — David L Sorkin
*Assistant Examiner* — Noor F Ahmad
(74) *Attorney, Agent, or Firm* — Cooper Legal Group, LLC

(57) ABSTRACT

Disclosed is a continuous and forced asphalt mixing production method, which relates to the technical field of concrete processing and includes the following steps of: heating a cold aggregate to obtain a hot aggregate, hot mixing and/or cold mixing the milled materials to obtain recycled materials; blending the hot aggregate, the recycled materials, the powder materials and the asphalt to obtain a premix; temporarily storing the premix in a pre-stirring storage bin and then stirring the premix in a forced stirring cylinder, temporarily storing the obtained finished product materials in a finished product storage bin; in the finished product material loading area, unloading into a storage tank of a finished product material conveying vehicle.

10 Claims, 3 Drawing Sheets

(51) Int. Cl.
*B01F 27/116* (2022.01)
*B01F 35/90* (2022.01)

(52) U.S. Cl.
CPC ..... *B01F 33/8364* (2022.01); *B01F 2035/99* (2022.01); *B01F 2101/38* (2022.01)

(58) Field of Classification Search
CPC ..... B01F 35/90; B28C 5/003; B28C 7/0023; B28C 7/0422; C04B 26/26; E01C 19/08; E01C 19/1004; E01C 19/1036; E01C 2301/50; E01C 7/22
USPC ..... 366/7, 22–25
See application file for complete search history.

(56) References Cited

U.S. PATENT DOCUMENTS

| | | | | |
|---|---|---|---|---|
| 5,596,935 | A * | 1/1997 | Swanson | F23G 7/14 432/106 |
| 6,196,710 | B1 * | 3/2001 | Swanson | E01C 19/1031 34/131 |
| 9,206,565 | B2 * | 12/2015 | Su | E01C 19/1004 |
| 9,457,354 | B2 * | 10/2016 | Svec | B02C 19/0056 |
| 10,080,987 | B1 * | 9/2018 | Crawford | E01C 19/1059 |
| 10,288,349 | B2 * | 5/2019 | Swanson | F26B 23/002 |
| 2007/0070801 | A1 * | 3/2007 | Musil | E01C 19/1036 366/25 |

FOREIGN PATENT DOCUMENTS

| | | |
|---|---|---|
| CN | 103103908 | 5/2013 |
| CN | 104032650 | 9/2014 |
| CN | 108532415 | 9/2018 |
| CN | 208604451 | 3/2019 |

* cited by examiner

CONTINUOUS AND FORCED ASPHALT MIXING PRODUCTION METHOD

CROSS-REFERENCE TO RELATED APPLICATION

This application claims a priority to Chinese Patent Application Serial No. 201910984537.9 filed on Oct. 16, 2019, Chinese Patent Application Serial No. 201910984563.1 filed on Oct. 16, 2019, and Chinese Patent Application Serial No. 202010043651.4 filed on Jan. 15, 2020. The entirety of each of the above-mentioned patent applications is incorporated herein by reference and made a part of this specification.

BACKGROUND

Technical Field

The present application relates to the technical field of concrete processing, and more particularly, to a continuous and forced asphalt mixing production method.

Description of Related Art

The asphalt concrete pavement has good drive comfort and excellent performance, is fast in construction speed and low in maintenance cost, and therefore, asphalt pavements are mostly used for all grades of highways. Currently, hot mixing of asphalt mixture is a main method for the construction of asphalt concrete pavement and is also a key link for asphalt concrete pavement construction. The hot mixing of asphalt mixture mainly depends on advanced stirring equipment to obtain accurate and uniform pavement mixture materials, by scientifically and reasonably adjust high-quality components, and sufficiently heating and mixing.

At present, an existing asphalt mixture is obtained by mixing new materials and recycled materials in proportion, in which most of the recycled materials are obtained by treating waste asphalt materials in a hot mixing mode or a cold mixing mode.

In a common hot mixing treatment process, since an open flame is in direct contact with recycled materials, the recycled materials subjected to hot mixing can generate a large amount of waste asphalt flue gas which contains a large quantity of volatile components (derived from waste asphalt materials). If being directly discharged to the air, such an amount of volatile components will cause pollution to the environment; and if being treated by a tail gas absorbing device, a high-power tail gas absorbing device and long working time will be required to complete the treatment to the tail gas, because too many volatile components are generated. If it goes on, a large amount of time and electric energy will be consumed, and operating costs of the company will be thus increased. Therefore, there is a need to provide a new technical solution to solve the above problem.

SUMMARY

In one aspect, the present application provides a continuous and forced asphalt mixing production method, which avoids directly burning the milled materials by an open flame. In addition, a hot aggregate is slowly premixed with the recycled materials, the powder materials and the asphalt, therefore, the mixing efficiency is high, and at the same time, it is also possible to avoid leakage of asphalt flue gas and make full use of heat energy, which is energy-saving and environmentally friendly.

In one embodiment, the present application provides a continuous and forced asphalt mixing production method, including the operating steps:

Step 1, pre-treating a cold aggregate and milled materials;

Step 2, heating the cold aggregate in a drying cylinder to obtain a hot aggregate, treating the milled materials in a heat transfer manner using hot mixing and/or cold mixing, to obtain recycled materials;

Step 3, weighing and storing the hot aggregate, the recycled materials, powder materials and asphalt;

Step 4, blending the hot aggregate, the recycled materials, the powder materials and the asphalt to obtain a premix;

Step 5, temporarily storing the premix in a pre-stirring storage bin, opening the bin to unload the premix when the premix achieves 90% to 100% of the total capacity of the pre-stirring storage bin, then stirring the premix for 15 to 30 seconds in a forced stirring cylinder, to obtain finished product materials;

Step 6, temporarily storing the finished product materials in a finished product storage bin;

Step 7, in a finished product material loading area, unloading the finished product materials in the finished product storage bin into a storage tank of a finished product material conveying vehicle; and Step 8, introducing both a asphalt flue gas and a water vapor generated in Step 4 and Step 5 into the drying cylinder for a secondary incineration; discharging the dust collected in Step 6 into a tail gas absorption and purification device for a tail gas purification and absorption; and meanwhile, introducing a mixed gas of a flue gas and an air collected in Step 6 into a burner part of the drying cylinder to be used as a combustion-supporting gas.

In the above technical solution, the recycled materials are obtained in a heat transfer manner using hot mixing and/or cold mixing, by which the present application avoids directly burning the milled materials by an open flame, therefore, in the recycling process of the milled materials, a large amount of volatile asphalt components will not be generated, reducing the treatment duration of the tail gas absorption and purification device and a content of the tail gas to be treated in the subsequent process. Thus, energy consumption is effectively reduced, and the protective effect on the environment is improved. Meanwhile, the hot aggregate is slowly premixed with the recycled materials, the powder materials and the asphalt. In this case, the higher temperature of the hot aggregate can heat and gasify part of water vapor in the recycled materials, which avoids large positive pressure generated due to the fact that heating is too fast at a time. Thus, the safety performance during the production process is improved, meanwhile, the phenomenon of dust flying and asphalt flue gas leakage due to positive pressure is also avoided. In addition, the mixed gas of the flue gas and the air collected in the finished product material loading area is introduced into a burner part of the drying cylinder to be used as a combustion-supporting gas, which further improves utilization rate of the asphalt flue gas and greatly improves the working environment.

In a preferred embodiment,

Step 1 includes:

A1, formulating the cold aggregate at a normal temperature according to grading requirements;

A2, heating the cold aggregate in an inner cylinder of a double-layered split-flow drying cylinder at a temperature of 200° C. to 240° C. to obtain the hot aggregate;

A3, thermal insulating and temporarily storing the hot aggregate in a hot aggregate bin at a temperature of 180° C. to 200° C.;

Step 2 includes:

B1, conducting primary proportioning on the milled materials at the normal temperature according to grading requirements;

B2, hot mixing the milled materials at a temperature of 150° C. to 180° C. in an interlayer cavity of the double-layered split-flow drying cylinder in a heat transfer manner, raising the temperature of hot-mixed and recycled materials from 0° C.-20° C. to 50° C.-120° C. to obtain the hot-mixed and recycled material; and B3, thermal insulating and temporarily storing the hot-mixed and recycled materials in a hot-mixed and recycled material bin at a temperature of 80° C. to 120° C.;

Step 3 includes:

C1, weighing the hot aggregate and the hot-mixed and recycled materials according to requirements of the mixture on gradation and temperature;

C2, temporarily storing the weighed a hot aggregate in a first storage bin; and meanwhile, temporarily storing the hot-mixed and recycled materials in a second storage bin;

C3, recovering dust in the tail gas absorption and purification device, weighing according to grading requirements, and then temporarily storing in a third storage bin; and C4, weighing a petroleum asphalt according to grading requirements, storing the weighed petroleum asphalt in an asphalt storage bin, and subsequently conveying the petroleum asphalt into a continuous stirring cylinder for blending;

Step 4 includes:

pre-stirring the hot aggregate in the first storage bin, the hot-mixed and recycled materials in the second storage bin, the powder materials in the third storage bin and the petroleum asphalt in the asphalt storage bin to obtain the premix; and Step 5 includes:

temporarily storing the premix in a pre-stirring storage bin, opening the bin to unload the premix when the premix achieves more than 90% of the total capacity of the pre-stirring storage bin, then stirring the premix for 15 to 30 seconds in a forced stirring cylinder, to obtain the finished product materials.

By adopting the above technical solutions, the milled materials are heated in a heat transfer manner, then mixed to obtain hot-mixed and recycled materials, thus avoiding directly burning the milled materials (waste asphalt contains volatile asphalt components) by an open flame, and thereby further reducing pollution on the environment caused by direct discharge of the volatile asphalt components into the atmosphere. In addition, the milled materials are discharged into the interlayer cavity of the double-layered split-flow drying cylinder, and heat in the inner cylinder can be transferred to the interlayer cavity via the inner cylinder wall of the double-layered split-flow drying cylinder. This avoids an open flame from directly contacting the milled materials without affecting heating on the milled materials, which is convenient and efficient. Meanwhile, by strictly controlling the temperature, the rising temperature of the waste asphalt mixture is guaranteed, while the phenomenon of asphalt aging during heating can be avoided.

In a further embodiment,

Step 1 includes:

A1, conducting primary proportioning on fresh materials at a normal temperature according to grading requirements to obtain the cold aggregate;

A2, discharging the cold aggregate into the cold aggregate drying cylinder, heating and drying at a temperature of 200° C. to 300° C. to obtain a hot aggregate; and A3, thermal insulating and temporarily storing the hot aggregate in a hot aggregate bin at a temperature of 180° C. to 240° C.;

Step 2 includes:

B1, conducting primary proportioning on milled materials at the normal temperature according to grading requirements, to obtain a cold-mixed and recycled material;

Step 3 includes:

C1, weighing the hot aggregate and the cold-mixed and recycled materials according to requirements of the mixture on gradation and temperature;

C2, temporarily storing the weighed a hot aggregate in a first storage bin; and meanwhile, temporarily storing the cold-mixed and recycled materials in a second storage bin;

C3, recovering dust in the tail gas absorption and purification device, weighing according to grading requirements, and then temporarily storing in a third storage bin; and C4, weighing a petroleum asphalt according to grading requirements, storing the weighed petroleum asphalt in an asphalt storage bin, and subsequently conveying the petroleum asphalt into a continuous stirring cylinder for blending;

Step 4 includes:

pre-stirring the hot aggregate in the first storage bin, the cold-mixed and recycled materials in the second storage bin, the powder materials in the third storage bin and the petroleum asphalt in the asphalt storage bin to obtain the premix; and Step 5 includes:

temporarily storing the premix in a pre-stirring storage bin, opening the bin to unload the premix when the premix achieves more than 90% of the total capacity of the pre-stirring storage bin, then stirring the premix for 15 to 30 seconds in a forced stirring cylinder, to obtain the finished product materials.

By adopting the above technical solutions, the milled materials are recycled by cold mixing. In this case, the pollution into the atmosphere caused by direct burning due to discharge of the volatile components in the waste asphalt can be reduced. Meanwhile, a pre-stirring operation is added in Step 3, so that the addition ratio of the cold-mixed and recycled materials can be increased, which greatly improves the ratio of the cold-mixed and recycled materials in the mixture, thus increasing the utilization rate of the recycled materials, and is environmentally friendly.

In a preferred embodiment, when the hot-mixed and recycled materials are prepared according to grading requirements, in Step 3, the gradation weight ratio of the hot-mixed and recycled materials to the hot aggregate is 1:(1-2).

By adopting the above technical solution, the hot-mixed and recycled materials obtained by the above operation reduce the generation of exhaust gas, increase the usage amount of the hot-mixed and recycled materials, and greatly save the demand amount for the fresh materials, which helps to save costs and improve the utilization rate of waste asphalt (i.e., milled materials).

In a preferred embodiment, when the hot-mixed and recycled materials are prepared, in Step 4, the asphalt flue gas and the water vapor generated when pre-stirring the hot aggregate, the hot-mixed and recycled materials, the powder materials and the petroleum asphalt firstly enter the interlayer cavity of the double-layered split-flow drying cylinder for preheating, and are discharged into the inner cylinder of the double-layered split-flow drying cylinder from the discharge port of the inner cylinder for a secondary combustion, and finally the flue gas in the double-layered split-flow drying cylinder is discharged into the tail gas absorption and purification device again for a purification.

By adopting the above technical solution, the water vapor generated when the hot aggregate and the hot-mixed and recycled materials are pre-stirred is discharged into the interlayer cavity of the double-layered split-flow drying cylinder, so as to achieve a good heat insulation effect since the water vapor has a certain temperature at this time. Meanwhile, the water vapor contains a large amount of small water beads, so that certain fire and flame retardant properties can be achieved. In addition, water vapor does not directly enter the inner cylinder, which avoids the problem that asphalt flue gas and water vapor enters excessively at a burst, and causes the flame in the inner cylinder to be directly extinguished or the phenomenon that the inner cylinder generates a relatively high positive pressure, therefore, the safety performance is improved.

In a preferred embodiment, when the cold-mixed and recycled materials are prepared according to grading requirements, in Step 3, the gradation weight ratio of the cold-mixed and recycled materials to the hot aggregate is 1:(1.5-3).

In a preferred embodiment, when the cold-mixed and recycled materials are prepared according to grading requirements, in Step 3, the gradation weight ratio of the cold-mixed and recycled materials to the hot aggregate is 3:7.

In the existing technology, since the cold-mixed and recycled materials contain a large amount of water vapor, the large amount of water vapor will affect the usage amount of the cold-mixed and recycled materials. The specific reason is that, during the production process of the whole asphalt mixture, the residual moisture content of the aggregates needs to be controlled strictly, the moisture content should not be greater than 1%. Therefore, the gradation weight ratio of the cold-mixed and recycled materials to the hot aggregate can only be maintained at 1:9, it can be seen that the usage amount of the cold-mixed and recycled materials is very low, which correspondingly improves production costs of the whole project. However, the above technical solution adopts a pre-blending manner, improves the usage amount of the cold-mixed and recycled materials, and greatly increases the consumption to the cold-mixed and recycled materials, which helps to save costs and improve the utilization rate of waste asphalt (i.e., milled materials).

In a preferred embodiment, in C4, weighing petroleum asphalt according to grading requirements, storing the weighed petroleum asphalt in the asphalt storage bin, mixing with water to form a foamed asphalt, and subsequently conveying the foamed asphalt into the continuous stirring cylinder for blending; and, in Step 5, stirring the premix for 15 to 30 seconds in the forced stirring cylinder, to obtain the finished product materials controlled at a temperature of 130° C. to 140° C.

By adopting a pre-blending manner, when asphalt is added into a continuous stirring cylinder, a water pump is started, and water and petroleum asphalt are mixed firstly, in which the mixing ratio of the water to the petroleum asphalt is controlled to be 1:(50-100). In this way, the water is rapidly gasified in the petroleum asphalt (which has a temperature 160° C.-180° C.), leaving a plurality of hole structures in the asphalt and on the outer surface of the asphalt so as to provide a foamed asphalt. In this way, the surface area of the prepared foamed asphalt is greatly increased, and the contact area between the foamed asphalt and the recycled materials, the hot aggregate, the powder materials and the like is increased, so as to achieve a good mixing effect when the temperature of the forced stirring cylinder in Step 5 is at a lower temperature (i.e., 130° C.-140° C.).

In a preferred embodiment, in Step 4, a pre-stirring speed is 20-300 r/min, a stirring time is 0.2-20 min, and a temperature is 160° C.-180° C.

By adopting the above technical solution, the pre-stirring mainly plays a role of mixing asphalt, the recycled materials, a hot aggregate and powder materials into a continuous stirring cylinder by means of slowly entering the continuous stirring cylinder in batches. The main purpose is to prolong the time for the premix to enter the forced stirring cylinder, allowing asphalt, the recycled materials, a hot aggregate and powder materials to be gradually blended. Therefore, large positive pressure generated due to sharp gasification of water vapor at high temperatures can be reduced, and asphalt flue gas leakage can be effectively avoided, which is environmentally friendly.

In a preferred embodiment, in Step 4, the gradation weight ratio of the hot aggregate to the powder materials to the asphalt is (2-3):(0.2-0.3):(0.5-1).

In a preferred embodiment, the powder materials are one or more selected from the group consisting of a mineral powder, a stone or a sand; and the asphalt is a petroleum asphalt.

In summary, the embodiments of the present invention have the following beneficial effects:

1. The present application avoids directly burning the milled materials by an open flame; meanwhile, a hot aggregate is slowly premixed with the recycled materials, the powder materials and the asphalt, therefore, the mixing efficiency is high, and at the same time, it is also possible to avoid leakage of asphalt flue gas and make full use of heat energy, which is energy-saving and environmentally friendly.

2. Optimally, the water vapor generated when pre-stirring the hot aggregate and the hot-mixed and recycled materials is discharged into the interlayer cavity of the double-layered split-flow drying cylinder. In this way, a good heat insulation effect since the water vapor has a certain temperature and can achieve. Meanwhile, the water vapor contains a large amount of small water beads, so that certain fire and flame retardant properties can be achieved. In addition, water vapor does not directly enter the inner cylinder, which avoids the problem that asphalt flue gas and water vapor enters excessively at a burst, and causes the flame in the inner cylinder to be directly extinguished or the phenomenon that the inner cylinder generates a relatively high positive pressure, therefore, the safety performance is improved.

3. Optimally, compared with traditional two-cylinder heating, the use of double-layered single-cylinder heating when the hot-mixed and recycled materials are prepared, reduces heat loss, is more energy-saving and environmentally friendly, lowering the temperature of the drying cylinder, and prolongs the service life.

DESCRIPTION OF THE EMBODIMENTS

Figure 1:
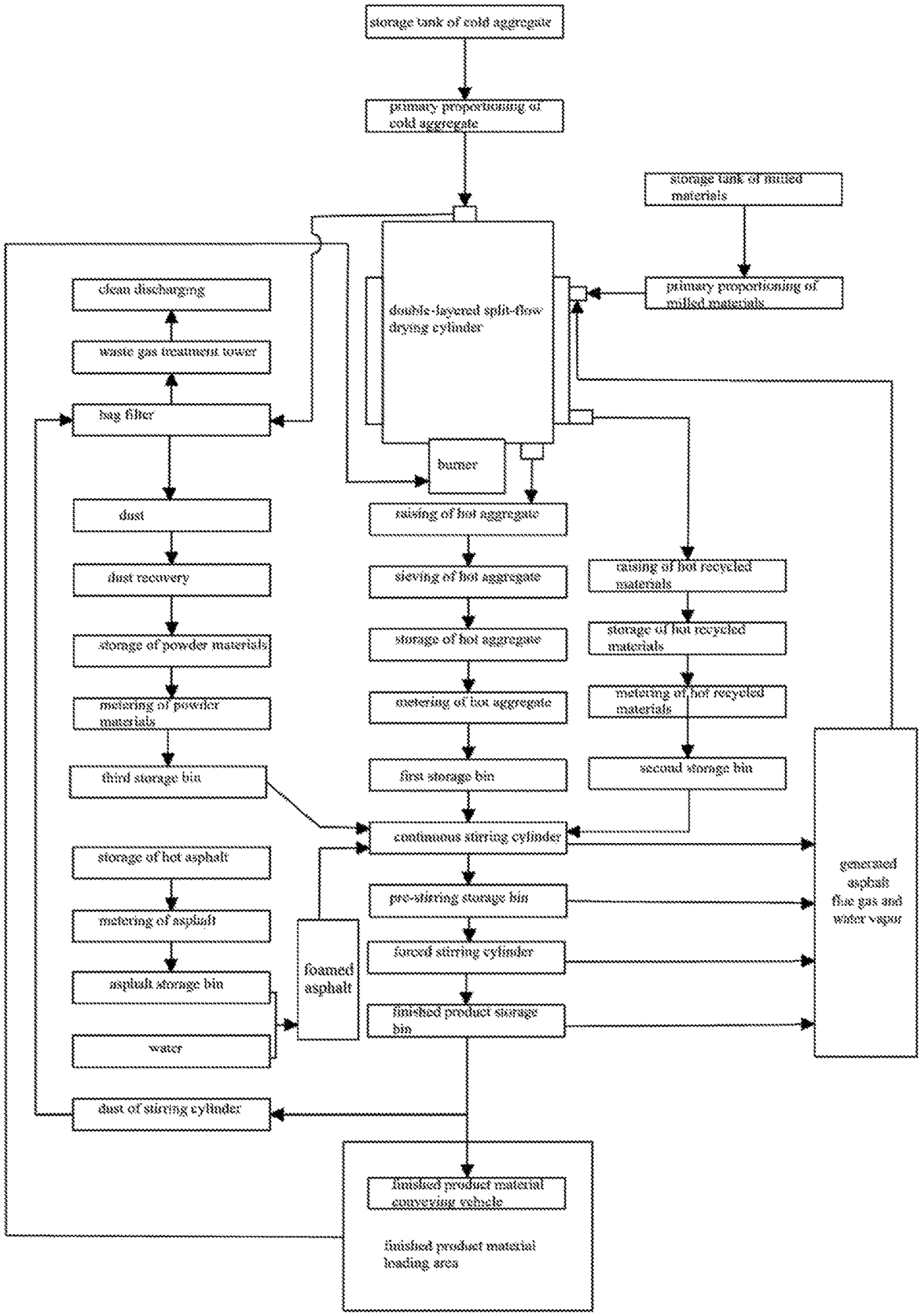
FIG. 1 is a flowchart of a continuous and forced asphalt mixing production method according to Example 1-1 of the present application.

The present application will be further illustrated in detail in combination with the accompanying drawings below.

In one embodiment, a double-layered split-flow drying cylinder is used. The double-layered split-flow drying cylinder is cylindrical in shape and includes a bracket, an inner cylinder rotatably arranged on the bracket, and a housing fixed onto the bracket. A burner is arranged on the bracket, one end of which extends into the inner cylinder in the central axis direction of the double-layered split-flow drying cylinder from one end thereof, for heating and burning the materials in the inner cylinder. An interlayer cavity is formed between the inner cylinder and the housing, a first discharge pipe and a second discharge pipe are arranged at the bottom of the housing, and a partition plate is arranged between the first discharge pipe and the second discharge pipe, so as to achieve the effect of separating materials in the inner cylinder from materials in the outer cylinder without hindering air circulation. Meanwhile, a discharge port is formed on the cylindrical sidewall of the inner cylinder close to the burner. In this case, when the discharge port of the inner cylinder rotates with the inner cylinder to correspond to the second discharge pipe up and down, materials in the inner cylinder can be discharged out of the inner cylinder along the second discharge pipe, while the materials in the interlayer cavity can be discharged out of the interlayer cavity along the first discharge pipe after sufficiently absorbing the high temperature obtained by the burner, so that the heat energy in the double-layered split-flow drying cylinder is fully utilized, the heat loss is reduced, and it is more energy-saving and environmentally friendly. In one embodiment, the double-layered split-flow drying cylinder described above may adopt the drying cylinder provided in Chinese Patent No. CN02102101.5.

In another embodiment, a tail gas absorption and purification device is used. The tail gas absorption and purification device includes successively arranged bag filter, waste gas treatment tower and purified gas discharge chimney, and can be used to absorb and purify tail gas (also referred to as asphalt flue gas). In one embodiment, the tail gas absorption and purification device described above can adopt the structure shown in FIG. 2 of Chinese Patent Application No. CN201010532075.6 entitled "the asphalt flue gas absorption method and device". That is, an outer cylinder is fixedly connected outside a single-layered drying cylinder, in which one end of the outer cylinder is closed while the other end thereof is opened. A chute and a channel are arranged at the closed end in the outer cylinder to communicate the outer cylinder with the inner cylinder. Thrust plates are arranged on the inner wall of the outer cylinder, and the inner wall/outer wall of the inner cylinder, to enable directional movement of materials. Materials move against the fuel gas stroke in the drying cylinder, get preheated in an interlayer between the outer cylinder and the inner cylinder by the hot inner cylinder and tail gas and then enter the inner cylinder to be continuously heated.

I. Examples: Using Hot Mixing Process

Example 1-1: A continuous and forced asphalt mixing production method, as shown in FIG. 1, including the following operating steps.

Step 1

A1, conducting primary proportioning on fresh materials at a normal temperature according to grading requirements to obtain a cold aggregate, in which the cold aggregate included 18-31.5 mm crushed stone, 10-20 mm crushed stone and 5-10 mm crushed stone at a weight ratio of 21:18:18;

A2, discharging the cold aggregate into an inner cylinder of a double-layered split-flow drying cylinder for combustion, raising the temperature of the double-layered split-flow drying cylinder to 100° C. to dry the cold aggregate first, and then continuing to raise the temperature of the double-layered split-flow drying cylinder to 200° C. to heat the cold aggregate to 180° C. to provide a hot aggregate; and A3, thermal insulating and temporarily storing the hot aggregate in a hot aggregate bin at a temperature of 180° C.

Step 2

B1, conducting primary proportioning on milled materials at a normal temperature according to grading requirements, in particular, firstly, milling and smashing waste asphalt materials, then screening out the milled materials with a particle size ranging from 10 mm to 30 mm for blending, smashing again the milled materials with a particle size of greater than 30 mm and then sieving, and collecting the milled materials with a particle size of smaller than 10 mm as waste materials in a centralized manner;

B2, hot mixing the milled materials at a temperature of 180° C. in an interlayer cavity of the double-layered split-flow drying cylinder in a heat transfer manner, so as to raise the temperature of the milled materials from 10° C. to 100° C. to obtain a hot-mixed and recycled materials; and B3, thermal insulating and temporarily storing the hot-mixed and recycled materials in a hot-mixed and recycled material bin at a temperature of 90° C.

Step 3

C1, weighing the hot aggregate and the hot-mixed and recycled materials according to requirements of the mixture on gradation and temperature, so that the gradation weight ratio of the hot-mixed and recycled materials to the hot aggregate was 1:2;

C2, temporarily storing the weighed a hot aggregate in a first storage bin; and meanwhile, temporarily storing the hot-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, and subsequently conveying the petroleum asphalt into a continuous stirring cylinder for blending.

Step 4 weighing the hot aggregate, the hot-mixed and recycled materials, powder materials and the petroleum asphalt by a weight ratio of 2:1:0.25:0.85, pre-treating the hot aggregate the hot-mixed and recycled materials, powder materials and the petroleum asphalt under stirring in a continuous stirring cylinder at a stirring speed of 100 r/min, to obtain pre-stirred materials at a temperature of about 170° C.

When the hot-mixed and recycled materials in Step 4 were prepared, asphalt flue gas and water vapor generated when the hot aggregate, the hot-mixed and recycled materials, powder materials and the petroleum asphalt were pre-treated firstly enter the interlayer cavity of the double-layered split-flow drying cylinder for preheating, and subsequently discharged into the inner cylinder of the double-layered split-flow drying cylinder from the discharge port of the inner cylinder for secondary combustion, and finally the flue gas in the double-layered split-flow drying cylinder was discharged into the tail gas absorption and purification device again for purification.

Step 5 pre-stirring the mixture obtained in Step 4 for 20 seconds, then storing the mixture in a pre-stirring storage bin, and subsequently, stirring the mixture for 20 seconds in a forced stirring cylinder at the stirring speed of 200 r/min, to obtain finished product materials at a temperature of about 170° C.

In particular, the continuous stirring cylinder as used was Model 800*3500 Concrete Continuous Spiral Stirrer available from Henan Huajin Mechanical Equipment Co., Ltd. The forced stirring cylinder as used was Model JS750 Forced Stirrer Horizontal Biaxial Concrete Stirrer available from Shandong Zeyu Heavy Industry Science and Technology Co., Ltd.

Step 6 temporarily storing the finished product materials in a finished product storage bin.

Step 7 in the finished product material loading area, unloading the finished product materials in the finished product storage bin into a storage tank of a finished product material conveying vehicle.

Step 8 introducing both the asphalt flue gas and the water vapor generated in Step 4 and Step 5 into a double-layered split-flow drying cylinder for secondary incineration; discharging the dust collected in Step 6 into a tail gas absorption and purification device for tail gas purification and absorption; and introducing the mixed gas of the flue gas and the air collected in Step 6 into a burner part of the double-layered split-flow drying cylinder to be used as a combustion-supporting gas.

Example 2-1: A continuous and forced asphalt mixing production method, including the following operating steps.

Step 1

A1, conducting primary proportioning on fresh materials at a normal temperature according to grading requirements to obtain a cold aggregate, in which the cold aggregate included 18-31.5 mm crushed stone, 10-20 mm crushed stone and 5-10 mm crushed stone at a weight ratio of 22:20:19;

A2, discharging the cold aggregate into an inner cylinder of a double-layered split-flow drying cylinder for combustion, raising the temperature of the double-layered split-flow drying cylinder to 110° C. to dry the cold aggregate first, and then continuing to raise the temperature of the double-layered split-flow drying cylinder to 210° C. to heat the cold aggregate to 190° C. to provide a hot aggregate; and A3, thermal insulating and temporarily storing the hot aggregate in a hot aggregate bin at a temperature of 190° C.

Step 2

B1, conducting primary proportioning on milled materials at a normal temperature according to grading requirements, in particular, firstly, milling and smashing waste asphalt materials, then screening out the milled materials with a particle size ranging from 10 mm to 30 mm for blending, smashing again the milled materials with a particle size of greater than 30 mm and then sieving, and collecting the milled materials with a particle size of smaller than 10 mm as waste materials in a centralized manner;

B2, hot mixing the milled materials at a temperature of 180° C. in an interlayer cavity of the double-layered split-flow drying cylinder in a heat transfer manner so as to raise the temperature of the milled materials from 20° C. to 120° C. to obtain s hot-mixed and recycled materials; and B3, thermal insulating and temporarily storing the hot-mixed and recycled materials in a hot-mixed and recycled material bin at a temperature of 100° C.

Step 3

C1, weighing the hot aggregate and the hot-mixed and recycled materials according to requirements of the mixture on gradation and temperature, so that the gradation weight ratio of the hot-mixed and recycled materials to the hot aggregate was 1:1.5;

C2, temporarily storing the weighed hot aggregate in a first storage bin; and meanwhile, temporarily storing the hot-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, and subsequently conveying the petroleum asphalt into a continuous stirring cylinder for blending.

Step 4 weighing the hot-mixed and recycled materials, the hot aggregate, powder materials and the petroleum asphalt by a weight ratio of 1.6:2.4:0.2:0.8, pre-treating the hot aggregate, the hot-mixed and recycled materials, powder materials and the petroleum asphalt under stirring in a continuous stirring cylinder at a stirring speed of 20 r/min, to obtain pre-stirred materials at a temperature of about 180° C.

Step 5 pre-stirring the mixture obtained in Step 4 for 12 seconds, then storing the mixture in a pre-stirring storage bin, and subsequently, stirring the mixture for 20 seconds in a forced stirring cylinder at the stirring speed of 250 r/min, to obtain finished product materials at a temperature of about 165° C.

In particular, the continuous stirring cylinder as used was Model 800*3500 Concrete Continuous Spiral Stirrer available from Henan Huajin Mechanical Equipment Co., Ltd. The forced stirring cylinder as used was Model JS750 Forced Stirrer Horizontal Biaxial Concrete Stirrer available from Shandong Zeyu Heavy Industry Science and Technology Co., Ltd.

Step 6 temporarily storing the finished product materials in a finished product storage bin.

Step 7 in the finished product material loading area, unloading the finished product materials in the finished product storage bin into a storage tank of a finished product material conveying vehicle.

Step 8, introducing both the asphalt flue gas and the water vapor generated in Step 4 and Step 5 into a double-layered split-flow drying cylinder for secondary incineration; discharging the dust collected in Step 6 into a tail gas absorption and purification device for tail gas purification and absorption; and introducing the mixed gas of the flue gas and the air collected in Step 6 into a burner part of the double-layered split-flow drying cylinder to be used as a combustion-supporting gas.

Example 3-1: A continuous and forced asphalt mixing production method, including the following operating steps.

Step 1

A1, conducting primary proportioning on fresh materials at a normal temperature according to grading requirements to obtain a cold aggregate, in which the cold aggregate include 18-31.5 mm crushed stone, 10-20 mm crushed stone and 5-10 mm crushed stone at a weight ratio of 23:25:20;

A2, discharging the cold aggregate into an inner cylinder of a double-layered split-flow drying cylinder for combustion, raising the temperature of the double-layered split-flow drying cylinder to 120° C. to dry the cold aggregate first, and then continuing to raise the temperature of the double-layered split-flow drying cylinder to 220° C. to heating the cold aggregate to 200° C. to provide a hot aggregate; and A3, thermal insulating and temporarily storing the hot aggregate in a hot aggregate bin at a temperature of 200° C.

Step 2

B1, conducting primary proportioning on milled materials at a normal temperature according to grading requirements, in particular, firstly, milling and smashing waste asphalt materials, then screening out the milled materials with a particle size ranging from 10 mm to 30 mm for blending, smashing again the milled materials with a particle size of greater than 30 mm and then sieving, and collecting the milled materials with a particle size of smaller than 10 mm as waste materials in a centralized manner;

B2, hot mixing the milled materials at a temperature of 180° C. in an interlayer cavity of the double-layered split-flow drying cylinder in a heat transfer manner, so as to raise the temperature of the milled materials from 0° C. to 110° C. to obtain a hot-mixed and recycled materials; and B3, thermal insulating and temporarily storing the hot-mixed and recycled materials in a hot-mixed and recycled material bin at a temperature of 110° C.

Step 3

C1, weighing the hot aggregate and the hot-mixed and recycled materials according to requirements of the mixture on gradation and temperature, so that the gradation weight ratio of the hot-mixed and recycled materials to the hot aggregate to be 1:1;

C2, temporarily storing the weighed a hot aggregate in a first storage bin; and meanwhile, temporarily storing the hot-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, and subsequently conveying the petroleum asphalt into a continuous stirring cylinder for blending.

Step 4 weighing the hot-mixed and recycled materials, the hot aggregate, powder materials and the petroleum asphalt by a weight ratio of 3:3:0.3:1, pre-treating the hot aggregate, the hot-mixed and recycled materials, powder materials and the petroleum asphalt under stirring in a continuous stirring cylinder at a stirring speed of 300 r/min, to obtain pre-stirred materials at a temperature of about 160° C.

Step 5 pre-stirring the mixture obtained in Step 4 for 20 seconds, then storing the mixture in a pre-stirring storage bin, and subsequently, stirring the mixture for 30 seconds in a forced stirring cylinder at the stirring speed of 200 r/min, to obtain finished product materials at a temperature of about 160° C.

Step 6 temporarily storing the finished product materials in a finished product storage bin.

Step 7 in the finished product material loading area, unloading the finished product materials in the finished product storage bin into a storage tank of a finished product material conveying vehicle.

Step 8 introducing both the asphalt flue gas and the water vapor generated in Step 4 and Step 5 into a double-layered split-flow drying cylinder for secondary incineration; discharging the dust collected in Step 6 into a tail gas absorption and purification device for tail gas purification and absorption. Meanwhile, introducing the mixed gas of the flue gas and the air collected in Step 6 into a burner part of the double-layered split-flow drying cylinder to be used as a combustion-supporting gas.

Example 4-1:

A continuous and forced asphalt mixing production method differs from Example 1-1 in that: after weighing the petroleum asphalt, the petroleum asphalt first was firstly warm mixed by heating the petroleum asphalt to 140° C. and then adding a surfactant of quaternary ammonium salts (QAS) thereto in an amount of six thousandths of the amount (by weight) of petroleum asphalt.

Example 5-1:

A continuous and forced asphalt mixing production method differs from Example 1-1 in that in C4, petroleum asphalt was weighed according to grading requirements, stored in an asphalt storage bin, mixed with water to form foamed asphalt, and subsequently conveyed into a continuous stirring cylinder for blending, in which the weight ratio of water to petroleum asphalt was optionally 1:80.

Meanwhile, in Step 5, the mixture obtained in Step 4 after pre-stirring for 15 seconds was stored in a pre-stirring storage bin, and subsequently stirred for 20 seconds in a forced stirring cylinder at the stirring speed of 200 r/min, to obtain finished product materials at a temperature of about 140° C.

Example 6-1:

A continuous and forced asphalt mixing production method differs from Example 1-1 in that in C4, asphalt was weighed according to grading requirements, stored in an asphalt storage bin, mixed with water to form foamed asphalt, and subsequently conveyed into a continuous stirring cylinder for blending.

Meanwhile, in Step 5, the mixture obtained in Step 4 after pre-stirring for 15 seconds was stored in a pre-stirring storage bin, and subsequently stirred for 20 seconds in a forced stirring cylinder at the stirring speed of 200 r/min, to obtain finished product materials at a temperature of about 130° C.

Example 7-1:

A continuous and forced asphalt mixing production method differs from Example 1-1 in that in Step 4, the hot aggregate, the hot-mixed and recycled materials, powder materials and the petroleum asphalt were pre-stirred at a stirring speed of 30 r/min for 30 seconds to obtain a premix at a temperature of about 180° C.

In Step 4, the premix, powder materials and the petroleum asphalt were weighed according to asphalt configuration requirements at a weight ratio of 2.5:0.2:0.9. In Step 5, the premix obtained in Step 4 was uniformly mixed under stirring at a stirring speed of 250 r/min for 16 seconds to obtain a finished product material at a temperature of about 169° C.

II. Comparative Examples: Using Hot Mixing Process

Comparative Example 1-1:

An asphalt mixing production method differs from Example 1-1 in that, when preparing the hot-mixed and recycled materials, the milled materials were directly ignited by an open flame and heated to 150° C.

Comparative Example 2-1:

An asphalt mixing production method differs from Example 1-1 in: Step 2, B1, conducting primary proportioning on milled materials at a normal temperature according to grading requirements; B2, mixing the milled materials at 20° C. to obtain cold-mixed and recycled materials, and maintaining the gradation weight ratio of the cold-mixed and recycled materials to the hot aggregate to be 1:9.

III. Test Data Detection

Test 1: Performance of Solidified Asphalt Mixtures

Test Object: the solidified asphalt mixtures prepared in Examples 1-1 to 7-1 were used as test sample 1-1 to test sample 7-1, and the solidified asphalt mixtures prepared in Comparative Examples 1-1 to 2-1 were used as control sample 1-1 to control sample 2-1.

(i) Immersion Marshall Test

1. The solidified asphalt mixtures prepared in Examples 1-1 to 7-1 and the solidified asphalt mixtures prepared in Comparative Examples 1-1 to 2-1 were immersed in a thermostatic water tank at 60° C. and incubated for 0.5 h;

2. Test samples or control samples were placed on a Digital Marshall Stability Tester;

3. The upper and lower press heads of the Marshall tester were put into a thermostatic water tank to arrive at the same temperature;

4. A loading device was started to enable a test piece to bear the load at a loading speed of 50+/−5 mm/min; and 5. The stability and the flow value of the test piece were recorded or printed.

According to the highway engineering asphalt and asphalt mixture test procedure (JTGE20-2011), when the nominal maximum particle size of aggregate is larger than 26.5 mm, it is necessary to adopt a large-scale Marshall test piece with the size of 152.4 mm*95.3 mm, the maximum load of the tester is not smaller than 50 kN, and the reading is accurate to 0.1 kN. The curvature inner diameters φ of the upper and lower press heads are 152.4 mm+/−0.2 mm, and the pitch between the upper and lower press heads is 19.05 mm+/−0.1 mm.

TABLE 1-1

Detected Performance Data of Solidified Asphalt Mixtures

| Test Object | Marshall Stability (KN) | Flow Value (0.1 mm) | Detection Standard |
|---|---|---|---|
| Test sample 1-1 | 25.5 | 42.6 | JTGE20-2011 |
| Test sample 2-1 | 26.4 | 43.5 | JTGE20-2011 |
| Test sample 3-1 | 24.9. | 44.8 | JTGE20-2011 |
| Test sample 4-1 | 23.8. | 41.5 | JTGE20-2011 |
| Test sample 5-1 | 25.5. | 42.1 | JTGE20-2011 |
| Test sample 6-1 | 26.2. | 43.3 | JTGE20-2011 |
| Test sample 7-1 | 25.9. | 43.8 | JTGE20-2011 |
| Control sample 1-1 | 27.5. | 46.8 | JTGE20-2011 |
| Control sample 2-1 | 28.3. | 46.5 | JTGE20-2011 |

(ii) Tail Gas (Asphalt Flue Gas) Inspection

Test method: tail gases generated in the Examples 1-1 to 7-1 and the Comparative Examples 1-1 to 2-1 were collected in transparent glass bottles, 5 bottles of tail gases in each group were intercepted for 10-15 seconds, the tail gases were sealed and stored by using rubber caps, labeled respectively, and then recorded with odors respectively in the Table 2-1.

All the transparent glass bottles were sequentially taken out and placed in a laboratory, meanwhile, clean air in a corridor of the laboratory was collected in the transparent glass bottles, and the transparent glass bottles were sealed and stored through rubber caps to serve as blank control samples.

A piece of white paper was then taken as the substrate and the colors inside the transparent glass bottles were observed sequentially and recorded in Table 2-1.

It is understood that asphalt flue gas containing asphalt (asphalt flue gas) is generally mixed with a certain concentration of flue dust, which is brown or black, and has a strong stimulation effect.

TABLE 2-1

| Test object | Color and Odor Inspection |
|---|---|
| Test sample 1-1 | No apparent colors, no strong offensive odors |
| Test sample 2-1 | No apparent colors, no strong offensive odors |
| Test sample 3-1 | No apparent colors, no strong offensive odors |
| Test sample 4-1 | No apparent colors, no strong offensive odors |
| Test sample 5-1 | No apparent colors, no strong offensive odors |
| Test sample 6-1 | No apparent colors, no strong offensive odors |
| Test sample 7-1 | No apparent colors, no strong offensive odors |
| Control sample 1-1 | Gas was brown with offensive odors |
| Control sample 2-1 | No apparent colors, no strong offensive odors |
| Blank control samples (air) | No colors, no offensive odors |

Test results: As can be seen from Tables 1-1 and 2-1, the Marshall stability of the test samples 1-1 to 7-1 were not less than 8 KN, and flow values thereof were also between 15-45 mm, which complies with the general requirements of performance inspection, and the Marshall stability of the control samples 1-1 to 2-1 were not less than 8 KN, but flow values thereof exceeded 45 mm; therefore, performance stability of the control samples 1-1 to 2-1 was much less than that of the test samples 1-1 to test samples 7-1.

Meanwhile, the detection results of the test sample 1-1 to the test sample 7-1 showed that no apparent colors and no strong offensive odors; the blank control sample showed no colors, no offensive odors; the detection result of the control sample 1-1 showed that the gas was brown with offensive odors; the detection result of the control sample 2-1 showed no apparent colors, no strong offensive odors. As can be seen, the above manufacturing method by directly burning milled materials by an open flame will generate asphalt flue gas containing asphalt, which greatly pollutes the environment.

IV. Examples: Using Cold Mixing Process

Figure 2:
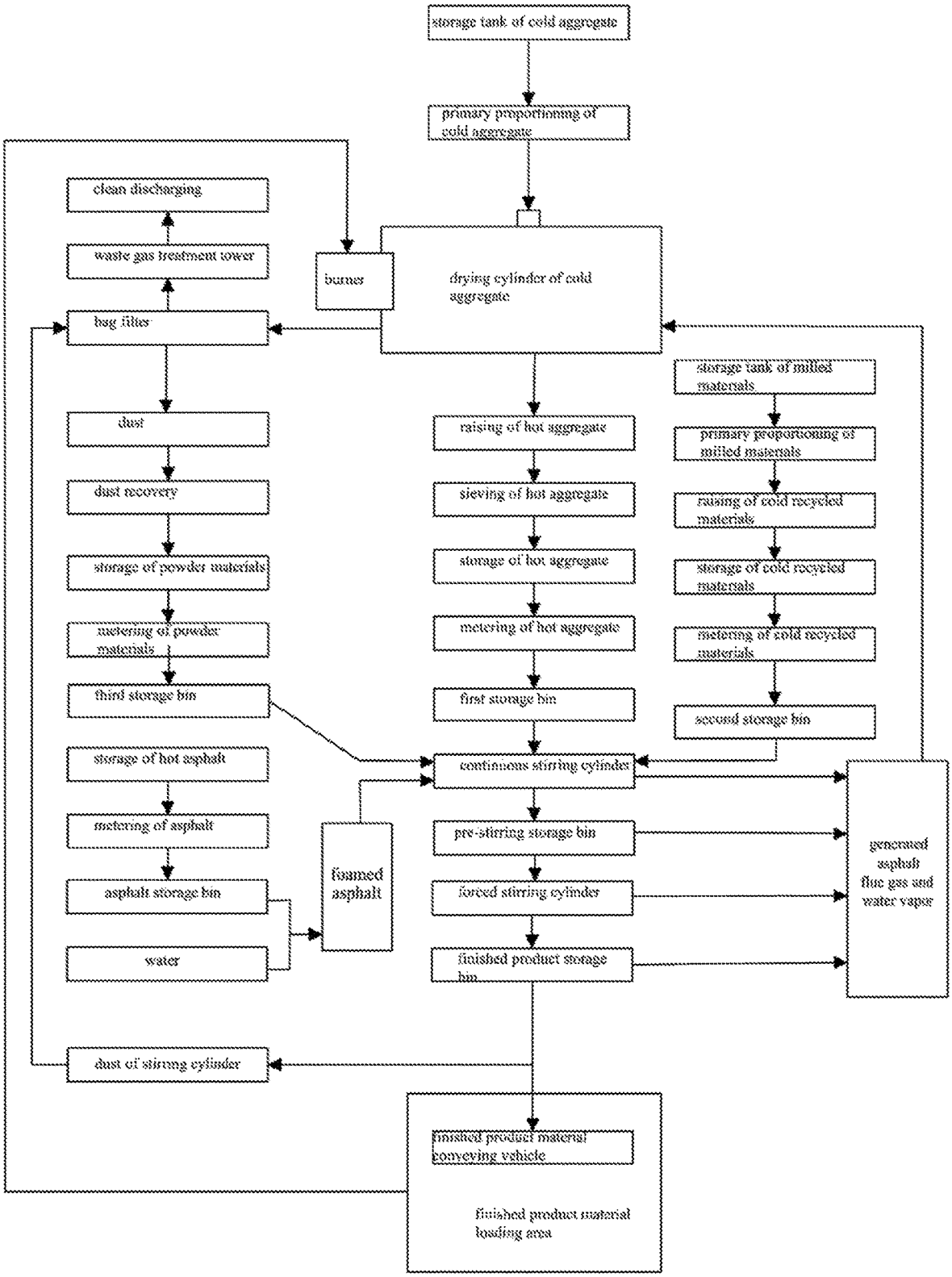
FIG. 2 is a flowchart of a continuous and forced asphalt mixing production method according to Example 2-1 of the present application.

Example 1-2: A continuous and forced asphalt mixing production method, as shown in FIG. 2, including the following operating steps.

Step 1

A1, conducting primary proportioning on fresh materials at a normal temperature according to grading requirements to obtain a cold aggregate, in which the cold aggregate include 18-31.5 mm crushed stone, 10-20 mm crushed stone and 5-10 mm crushed stone at a weight ratio of 21:18:18;

A2, discharging only the cold aggregate in A1 into the inner cylinder of the cold aggregate drying cylinder, and burning the cold aggregate in a burner at a temperature of 200° C. to obtain a hot aggregate, in which the cold aggregate drying cylinder was Model HG-1001 Horizontal Boiling Dryer avaible from Zhengzhou Huiguan Mechanical Equipment Co., Ltd; and A3, thermal insulating and temporarily storing the hot aggregate in a hot aggregate bin at a temperature of 180° C.

Step 2

B1, conducting primary proportioning on milled materials at a temperature of 15° C. according to grading requirements, in particular, firstly, milling and smashing waste asphalt materials, then screening out the milled materials with a particle size ranging from 0 mm to 30 mm (which is divided into three ranges of 0-10 mm, 10-16 mm, and 16-30 mm) for blending (i.e., primary proportioning), smashing again the milled materials with a particle size of greater than 30 mm and then sieving, to obtain cold-mixed and recycled materials.

Step 3,

C1, weighing the hot aggregate and the cold-mixed and recycled materials according to requirements of the mixture on gradation and temperature, so that the gradation weight ratio of the cold-mixed and recycled materials to the hot aggregate was 1:2.3;

C2, temporarily storing the weighed a hot aggregate in a first storage bin; and meanwhile, temporarily storing the cold-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, mixing with water to form foamed asphalt, and subsequently conveying the foamed asphalt into a continuous stirring cylinder for blending.

Step 4 pre-stirring the hot aggregate in the first storage bin, the cold-mixed and recycled materials in the second storage bin, powder materials in the third storage bin and the petroleum asphalt in the asphalt storage bin in a continuous stirring cylinder at a stirring speed of 200 r/min for 15 seconds, to obtain a premix at a temperature of about 180° C., in which the weight ratio of the hot aggregate to the powder materials to the asphalt was 2:0.3:0.5.

Step 5 temporarily storing the premix in a pre-stirring storage bin, opening the bin to unload the premix when the premix achieves more than 90% of the total capacity of the pre-stirring storage bin, then stirring the premix for 15 seconds in a forced stirring cylinder, to obtain finished product materials controlled at a temperature of about 130° C.

In particular, the continuous stirring cylinder as used was Model 800*3500 Concrete Continuous Spiral Stirrer available from Henan Huajin Mechanical Equipment Co., Ltd. The forced stirring cylinder as used was Model JS750 Forced Stirrer Horizontal Biaxial Concrete Stirrer available from Shandong Zeyu Heavy Industry Science and Technology Co., Ltd.

Water vapor generated when the hot aggregate and the cold-mixed and recycled materials (the cold-mixed and recycled materials contains moisture) were pre-stirred firstly enters via ducts from an air intake duct to an interlayer cavity of a cold aggregate drying cylinder for preheating, and subsequently discharged into the cold aggregate drying cylinder from the discharge port for secondary combustion, the flue gas in the cold aggregate drying cylinder was discharged into a bag filter and a waste gas treatment tower of the tail gas absorption and purification device again for purification, and finally the purified tail gas was discharged via a chimney.

Example 2-2: A continuous and forced asphalt mixing production method, including the following operating steps.

Step 1,

A1, conducting primary proportioning on fresh materials at a normal temperature according to grading requirements to obtain cold aggregate, in which the cold aggregate included 18-31.5 mm crushed stone, 10-20 mm crushed stone and 5-10 mm crushed stone at a weight ratio of 22.5:20:19;

A2, discharging only the cold aggregate in A1 into the inner cylinder of the double-layered split-flow drying cylinder, and burning the cold aggregate in a burner at a temperature of 210° C. to obtain hot aggregate; and A3, thermal insulating and temporarily storing the hot aggregate in a hot aggregate bin at a temperature of 190° C.

Step 2

B1, conducting primary proportioning on milled materials at a temperature of 30° C. according to grading requirements, in particular, firstly, milling and smashing waste asphalt materials, then screening out the milled materials with a particle size ranging from 0 mm to 30 mm for blending, smashing again the milled materials with a particle size of greater than 30 mm and then sieving, to obtain cold-mixed and recycled materials.

Step 3,

C1, weighing the hot aggregate and the cold-mixed and recycled materials according to requirements of the mixture on gradation and temperature, so that the gradation weight ratio of the cold-mixed and recycled materials to the hot aggregate was 1:1.5;

C2, temporarily storing the weighed a hot aggregate in a first storage bin; and meanwhile, temporarily storing the cold-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, mixing with water to form foamed asphalt, and subsequently conveying the foamed asphalt into a continuous stirring cylinder for blending.

Step 4 pre-stirring the hot aggregate in the first storage bin, the cold-mixed and recycled materials in the second storage bin, powder materials in the third storage bin and the petroleum asphalt in the asphalt storage bin in a continuous stirring cylinder at a stirring speed of 200 r/min for 15 seconds, to obtain a premix at a temperature of about 163° C., in which the weight ratio of the hot aggregate to the powder materials to the asphalt was 2:0.2:1.

Step 5 temporarily storing the premix in a pre-stirring storage bin, opening the bin to unload the premix when the premix achieves more than 90% of the total capacity of the pre-stirring storage bin, then stirring the premix for 15 seconds in a forced stirring cylinder, to obtain finished product materials at a temperature of about 135° C.

Water vapor generated when the hot aggregate and the cold-mixed and recycled materials (the cold-mixed and recycled materials contains moisture) were pre-stirred firstly enters via ducts from an air intake duct to an interlayer cavity of a cold aggregate drying cylinder for preheating, and subsequently discharged into the cold aggregate drying cylinder from the discharge port for secondary combustion, the flue gas in the cold aggregate drying cylinder was discharged into a bag filter and a waste gas treatment tower of the tail gas absorption and purification device again for purification, and finally the purified tail gas was discharged via a chimney.

Example 3-2: A continuous, forced asphalt mixing production method, including the following operating steps.

Step 1

A1, conducting primary proportioning on fresh materials at a normal temperature according to grading requirements to obtain cold aggregate, in which the cold aggregate include 18-31.5 mm crushed stone, 10-20 mm crushed stone and 5-10 mm crushed stone at a weight ratio of 23:25:20;

A2, discharging only the cold aggregate in A1 into the inner cylinder of the double-layered split-flow drying cylinder, and burning the cold aggregate in a burner at a temperature of 220° C. to obtain hot aggregate; and A3, thermal insulating and temporarily storing the hot aggregate in a hot aggregate bin at a temperature of 200° C.

Step 2

B1, conducting primary proportioning on milled materials at a temperature of 40° C. according to grading requirements, in particular, firstly, milling and smashing waste asphalt materials, then screening out the milled materials with a particle size ranging from 0 mm to 30 mm for blending, smashing again the milled materials with a particle size of greater than 30 mm and then sieving, to obtain cold-mixed and recycled materials.

Step 3

C1, weighing the hot aggregate and the cold-mixed and recycled materials according to requirements of the mixture on gradation and temperature, so that the gradation weight ratio of the cold-mixed and recycled materials to the hot aggregate was 1:3;

C2, temporarily storing the weighed a hot aggregate in a first storage bin; and meanwhile, temporarily storing the cold-mixed and recycled materials in a second storage bin;

C3, recovering dust in the tail gas absorption and purification device, weighing according to grading requirements, and then temporarily storing in a third storage bin; and C4, weighing petroleum asphalt according to grading requirements, storing the weighed petroleum asphalt in an asphalt storage bin, and subsequently conveying the petroleum asphalt into a continuous stirring cylinder for blending.

Step 4 at a temperature of 200° C., pre-stirring the hot aggregate in the first storage bin, the cold-mixed and recycled materials in the second storage bin, powder materials in the third storage bin and the petroleum asphalt in the asphalt storage bin in a continuous stirring cylinder at a stirring speed of 300 r/min for 15 seconds, to obtain a premix at a temperature of about 170° C., in which the weight ratio of the hot aggregate to the powder materials to the asphalt was 3:0.3:0.6.

Step 5 temporarily storing the premix in a pre-stirring storage bin, opening the bin to unload the premix when the premix achieves more than 90% of the total capacity of the pre-stirring storage bin, then stirring the premix for 15 seconds in a forced stirring cylinder, to obtain finished product materials controlled at a temperature of about 170° C.

Water vapor generated when the hot aggregate and the cold-mixed and recycled materials (the cold-mixed and recycled materials contains moisture) were pre-stirred firstly enters via ducts from an air intake duct to an interlayer cavity of a cold aggregate drying cylinder for preheating, and subsequently discharged into the cold aggregate drying cylinder from the discharge port for secondary combustion, the flue gas in the cold aggregate drying cylinder was discharged into a bag filter and a waste gas treatment tower of the tail gas absorption and purification device again for purification, and finally the purified tail gas was discharged via a chimney.

Example 4-2: A continuous and forced asphalt mixing production method differs from Example 1-2 in: Step 4, weighing the hot aggregate, the cold-mixed and recycled materials, powder materials and the petroleum asphalt according to asphalt configuration requirements, so that the gradation weight ratio of the hot aggregate to the powder materials to the petroleum asphalt was 2.2:0.25:0.8; then, pre-stirring the hot aggregate, the cold-mixed and recycled materials and powder materials in a continuous stirring cylinder at a stirring speed of 200 r/min, to obtain premix at a temperature of about 160° C.; and after 15 seconds, storing the premix in a storage bin, then uniformly stirring the mixture obtained in the previous step and petroleum asphalt in a forced stirring cylinder at a stirring speed of 200 r/min, and then storing the mixture in a finished product storage bin.

Example 5-2: A continuous and forced asphalt mixing production method differs from Example 1-2 in: Step 4, weighing the hot aggregate, the cold-mixed and recycled materials, powder materials and the petroleum asphalt according to asphalt configuration requirements, so that the gradation weight ratio of the hot aggregate to the powder materials to the petroleum asphalt was 2:0.29:0.54.

Example 6-2: A continuous and forced asphalt mixing production method differs from Example 1-2 in: Step 4, weighing the hot aggregate, the cold-mixed and recycled materials, powder materials and the petroleum asphalt according to asphalt configuration requirements; requiring the gradation weight ratio of the hot aggregate to the powder materials to the petroleum asphalt to be 2.9:0.3:0.6.

V. Comparative Example: Using Cold Mixing Process

Comparative Example 1-2: An asphalt mixing production method, which differs from Example 1-2 in that: when the cold-mixed and recycled materials are prepared, the milled materials are directly ignited by open flame and heated to 150° C.

Figure 3:
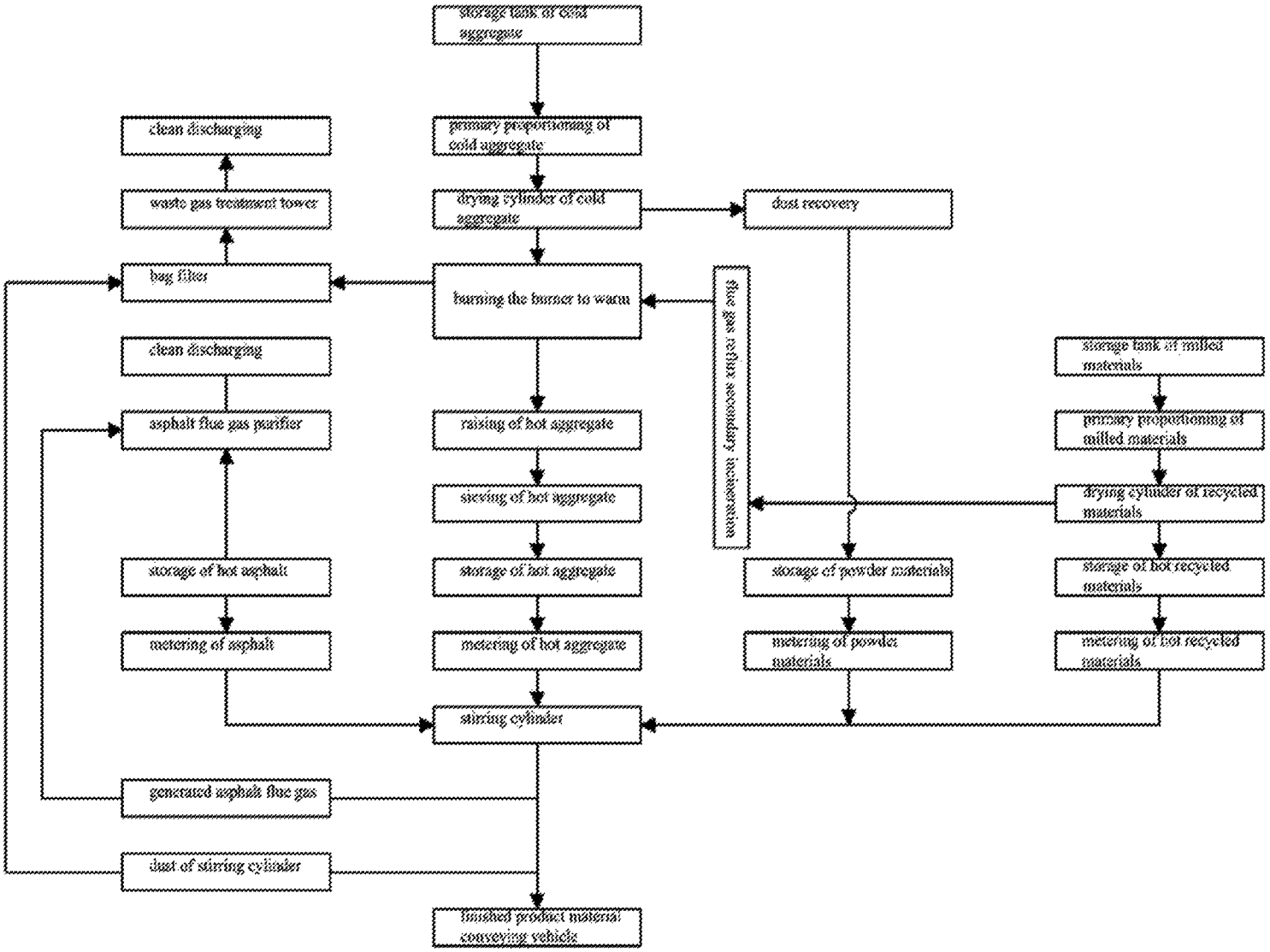
FIG. 3 is a flowchart of a continuous and forced asphalt mixing production method according to Comparative example 2-2 of the present application.

Comparative Example 2-2: An asphalt mixing production method, as shown in FIG. 3, which differs from Example 1-2 in that: there is no pre-blending step, and finally, in Step 5, the weight ratio of the cold-mixed and recycled materials to the hot aggregate is 1:9.

VI. Test Data Detection

Test Two: Performance of Solidified Asphalt Mixtures

Test Object: the solidified asphalt mixtures prepared in Examples 1-2 to 6-2 were used as test sample 1-2 to test sample 6-2, and the solidified asphalt mixtures prepared in Comparative Examples 1-2 to 2-2 were used as control sample 1-2 to control sample 2-2.

(i) Immersion Marshall Test

6. The solidified asphalt mixtures prepared in Examples to 1-6 and the solidified asphalt mixtures prepared in Comparative Examples to 1-2 were immersed in a thermostatic water tank at 60° C. and incubated for 0.5 h;

7. Test samples or control samples were placed on a Digital Marshall Stability Tester;

8. The upper and lower press heads of the Marshall tester were put into a thermostatic water tank to arrive at the same temperature;

9. A loading device was started to enable a test piece to bear the load at a loading speed of 50+/−5 mm/min;

10. The stability and the flow value of the test piece were recorded or printed.

According to the highway engineering asphalt and asphalt mixture test procedure (JTGE20-2011), when the nominal maximum particle size of aggregate is larger than 26.5 mm, it is necessary to adopt a large-scale Marshall test piece with the size of 152.4 mm*95.3 mm, the maximum load of the tester is not smaller than 50 kN, and the reading is accurate to 0.1 kN. The curvature inner diameters φ of the upper and lower press heads are 152.4 mm+/−0.2 mm, and the pitch between the upper and lower press heads is 19.05 mm+/−0.1 mm.

TABLE 1-2

Performance Detection Data of Solidified Asphalt Mixtures

| | Marshall Stability (KN) | Flow Value (0.1 mm) | Detection Standard |
|---|---|---|---|
| Test sample 1-2 | 20.5 | 44.1 | JTGE20-2011 |
| Test sample 2-2 | 22.6 | 40.9 | JTGE20-2011 |
| Test sample 3-2 | 24.1 | 43.5 | JTGE20-2011 |
| Test sample 4-2 | 22.1 | 42.2 | JTGE20-2011 |
| Test sample 5-2 | 23.5 | 40.5 | JTGE20-2011 |
| Test sample 6-2 | 21.8 | 43.2 | JTGE20-2011 |
| Control sample 1-2 | 27.5 | 46.8 | JTGE20-2011 |
| Control sample 2-2 | 28.3 | 46.5 | JTGE20-2011 |

(ii) Tail Gas (Asphalt Flue Gas) Inspection

Test method: tail gases generated in the Examples 1-2 to 6-2 and the Comparative Examples 1-2 to 2-2 were collected by using transparent glass bottles, 5 bottles of tail gases in each group were intercepted for 10-15 seconds, the tail gases were sealed and stored by using rubber caps, labelled respectively, and then recorded with odors respectively in the Table 2-2.

All the transparent glass bottles were sequentially taken out and placed in a laboratory, meanwhile, clean air in a corridor of the laboratory was taken and placed in the transparent glass bottles, and the transparent glass bottles were sealed and stored through rubber caps to serve as blank control samples.

A piece of white paper was then taken as the substrate and the colors inside the transparent glass bottles were observed sequentially and recorded in Table 2-2.

It is understood that asphalt flue gas containing asphalt (asphalt flue gas) is generally mixed with a certain concentration of flue dust, which is brown or black, and has a strong stimulation effect.

TABLE 2-2

Color and Odor Inspection

| | |
|---|---|
| Test sample 1-2 | No apparent colors, no strong offensive odors |
| Test sample 2-2 | No apparent colors, no strong offensive odors |
| Test sample 3-2 | No apparent colors, no strong offensive odors |
| Test sample 4-2 | No colors, no offensive odors |
| Test sample 5-2 | No colors, no offensive odors |
| Test sample 6-2 | No colors, no offensive odors |
| Control sample 1-2 | Gas was brown with offensive odors |
| Control sample 2-2 | No apparent colors, no strong offensive odors |
| Blank control samples (air) | No colors, no offensive odors |

Test results: As can be seen from Tables 1-2 and 2-2, the Marshall stability of the test samples 1-2 to 6-2 were not less than 8 KN, and flow values thereof were also between 15-45 mm, which complies with the general requirements of performance inspection, and the Marshall stability of the control samples 1-2 to 2-2 were not less than 8 KN, but flow values thereof exceeded 45 mm; therefore, performance stability of the control samples 1-2 to 2-2 was much less than that of the test samples 1-2 to the control samples 6-2.

Meanwhile, the detection results of the test sample 1-2 to the test sample 3-2 showed that no apparent colors and no strong offensive odors; the detection results of the test sample 4-2 to the test sample 6-2 showed that no colors; the blank control sample showed no colors, no offensive odors; the detection result of the control sample 1-2 showed that the gas was brown with offensive odors; the detection result of the control sample 2-2 showed no apparent colors, no strong offensive odors. As can be seen, the above manufacturing method by directly burning milled materials by an open flame will generate asphalt flue gas containing asphalt, which greatly pollutes the environment. In addition, only when the weight ratio of the cold-mixed and recycled materials to the hot aggregate in Comparative Example 2-2 is 1:9, and the gradation weight ratio of the cold-mixed and recycled materials to the hot aggregate in Example 1 is 1:2.3, the detected Marshall stability, flow values, colors and odors of the two can be close. As can be seen, the improved production process according to the present application can improve the addition amount of the cold-mixed and recycled materials to the maximum extent, and thus improve the utilization rate of waste asphalt (i.e., milled materials).

These embodiments are merely explanatory and are not restrictive of the application. After reading this specification, those skilled in the art can make various modifications to the embodiments as needed without creative work, which falls within the protection scope defined by the appended patent claims.

What is claimed is:

1. A continuous and forced asphalt mixing production method, comprising the following operating steps:

Step 1, pre-treating a cold aggregate and milled materials;

Step 2, heating the cold aggregate in a drying cylinder to obtain a hot aggregate, treating the milled materials in a heat transfer manner using hot mixing and/or cold mixing to obtain a recycled material;

Step 3, weighing and storing the hot aggregate, the recycled material, powder materials and asphalt;

Step 4, blending the hot aggregate, the recycled material, the powder materials and the asphalt to obtain a premix;

Step 5, temporarily storing the premix in a pre-stirring storage bin, opening the pre-stirring storage bin to unload the premix when the premix achieves more than 90% of a total capacity of the pre-stirring storage bin, then stirring the premix for 15 to 30 seconds in a forced stirring cylinder, to obtain a finished product material;

Step 6, temporarily storing the finished product material in a finished product storage bin;

Step 7, in a finished product material loading area, unloading the finished product material in the finished product storage bin into a storage tank of a finished product material conveying vehicle; and Step 8, introducing both asphalt flue gas and water vapor generated in Step 4 and Step 5 into the drying cylinder for a secondary incineration; discharging dust collected in Step 6 into a tail gas absorption and purification device for a tail gas purification and absorption; and introducing a mixed gas of a flue gas and air collected in Step 6 into a burner part of the drying cylinder to be used as a combustion-supporting gas.

2. The continuous and forced asphalt mixing production method according to claim 1, wherein Step 1 comprises:

A1, formulating the cold aggregate according to grading requirements;

A2, heating the cold aggregate in an inner cylinder of a double-layered split-flow drying cylinder at a temperature of 200° C. to 240° C. to obtain a second hot aggregate; and A3, thermal insulating and temporarily storing the second hot aggregate in a hot aggregate bin at a temperature of 180° C. to 200° C.;

Step 2 comprises:

B1, conducting primary proportioning on the milled materials according to grading requirements;

B2, hot mixing the milled materials at a temperature of 150° C. to 180° C. in an interlayer cavity of the double-layered split-flow drying cylinder in a heat transfer manner, raising the temperature of hot-mixed and recycled materials from 0° C-20° C. to 50° C-120° C. to obtain the hot-mixed and recycled materials; and B3, thermal insulating and temporarily storing the hot-mixed and recycled materials in a hot-mixed and recycled material bin at a temperature of 80° C. to 120° C.;

Step 3 comprises:

C1, weighing the hot aggregate and the hot-mixed and recycled materials according to requirement of the mixture on gradation and temperature;

C2, temporarily storing the weighed hot aggregate in a first storage bin; and meanwhile, temporarily storing the hot-mixed and recycled materials in a second storage bin;

C3, recovering the dust in the tail gas absorption and purification device, weighing according to grading requirements, and then temporarily storing in a third storage bin: and C4, weighing petroleum asphalt according to grading requirements, storing the weighed petroleum asphalt in an asphalt storage bin, and subsequently conveying the petroleum asphalt into a continuous stirring cylinder for blending;

Step 4 comprises pre-stirring the hot aggregate in the first storage bin, the hot-mixed and recycled materials in the second storage bin, the powder materials in the third storage bin and the petroleum asphalt in the asphalt storage bin to obtain the premix; and Step 5 comprises temporarily storing the premix in a pre-stirring storage bin, opening the pre-stirring storage bin to unload the premix when the premix achieves more than 90% of the total capacity of the pre-stirring storage bin, then stirring the premix for 15 to 30 seconds in the-a forced stirring cylinder, to obtain the finished product material.

3. The continuous and forced asphalt mixing production method according to claim 1, wherein Step 1 comprises:

A1, conducting primary proportioning on fresh materials to grading requirements to obtain the cold aggregate;

A2, discharging the cold aggregate into a cold aggregate drying cylinder, heating and drying at a temperature of 200° C. to 300° C. to obtain a second hot aggregate;

A3, thermal insulating and temporarily storing the second hot aggregate in a hot aggregate bin at a temperature of 180° C. to 240° C.;

Step 2 comprises:

B1, conducting primary proportioning on the milled materials according to grading requirements, to obtain cold-mixed and recycled materials;

Step 3 comprises:

C1, weighing the hot aggregate and the cold-mixed and recycled materials according to requirements of the mixture on gradation and temperature;

C2, temporarily storing the weighed hot aggregate in a first storage bin; and meanwhile, temporarily storing the cold-mixed and recycled materials in a second storage bin;

C3, recovering the dust in the tail gas absorption and purification device, weighing according to grading requirements, and then temporarily storing in a third storage bin;

C4, weighing petroleum asphalt according to grading requirements, storing the weighed petroleum asphalt in an asphalt storage bin, and subsequently conveying the petroleum asphalt into a continuous stirring cylinder for blending;

Step 4 comprises pre-stirring the hot aggregate in the first storage bin, the cold-mixed and recycled materials in the second storage bin, the powder materials in the third storage bin and the petroleum asphalt in the asphalt storage bin to obtain the premix; and Step 5 comprises temporarily storing the premix in the pre-stirring storage bin, opening the pre-stirring storage bin to unload the premix when the premix achieves 90% to 100% of the total capacity of the pre-stirring storage bin, then stirring the premix for 15 to 30 seconds in the forced stirring cylinder, to obtain the finished product material.

4. The continuous and forced asphalt mixing production method according to claim 2, wherein when the hot-mixed and recycled materials are prepared according to grading requirements, in Step 3, a gradation weight ratio of the hot-mixed and recycled materials to the hot aggregate is 1:(1-2).

5. The continuous and forced asphalt mixing production method according to claim 2, wherein when the hot-mixed and recycled materials are prepared, in Step 4, the asphalt flue gas and the water vapor, which are generated when the hot aggregate, the hot-mixed and recycled materials, the powder materials and the petroleum asphalt are pre-stirred, firstly enter the interlayer cavity of the double-layered split-flow drying cylinder for preheating, and subsequently discharged into the inner cylinder of the double-layered split-flow drying cylinder from a discharge port of the inner cylinder for a secondary combustion, and finally the flue gas in the double-layered split-flow drying cylinder is discharged into the tail gas absorption and purification device again for a purification.

6. The continuous and forced asphalt mixing production method according to claim 3, wherein when the cold-mixed and recycled materials are prepared according to grading requirements, in Step 3, a gradation weight ratio of the cold-mixed and recycled materials to the hot aggregate is 1:(1.5-3).

7. The continuous and forced asphalt mixing production method according to claim 2, wherein in C4, Step 2 comprises, weighing the petroleum asphalt according to grading requirements, storing the weighed petroleum asphalt in the asphalt storage bin, mixing with water to form a foamed asphalt, and subsequently conveying the foamed asphalt into the continuous stirring cylinder for blending; and, Step 5 comprises, stirring the premix for 15 to 30 seconds in the forced stirring cylinder, to obtain the finished product material controlled at a temperature of 130° C. to 140° C.

8. The continuous and forced asphalt mixing production method according to claim 7, wherein in Step 4, a pre-stirring speed is 20-300 r/min, a stirring time is 0.2-20 min, and a temperature is 160° C-180° C.

9. The continuous and forced asphalt mixing production method according to claim 7, wherein in Step 4, a gradation weight ratio of the hot aggregate to the powder materials to the asphalt is (2-3): (0.2-0.3): (0.5-1).

10. The continuous and forced asphalt mixing production method according to claim 1, wherein, the powder materials are one or more selected from the group consisting of a mineral powder, a stone or a sand; and the asphalt is a petroleum asphalt.

* * * * *